US008220188B1

(12) United States Patent
Keller

(10) Patent No.: US 8,220,188 B1
(45) Date of Patent: Jul. 17, 2012

(54) DEVICE FOR CONNECTING A PLACARD TO THE REARVIEW MIRROR OF A MOTOR VEHICLE AND METHOD OF USE

(76) Inventor: Martin E Keller, Fairfax, VA (US)

( * ) Notice: Subject to any disclaimer, the term of this patent is extended or adjusted under 35 U.S.C. 154(b) by 229 days.

(21) Appl. No.: 12/658,511

(22) Filed: Feb. 8, 2010

(51) Int. Cl.
*G09F 21/04* (2006.01)

(52) U.S. Cl. ..... 40/593; 40/643

(58) Field of Classification Search ..... 40/593, 40/643

See application file for complete search history.

(56) References Cited

U.S. PATENT DOCUMENTS 3,313,053 A * 4/1967 Vogeli, Sr. ..... 40/643
3,529,328 A * 9/1970 Davison ..... 24/303
4,671,482 A * 6/1987 Shapiro ..... 248/225.21
5,137,158 A * 8/1992 Brockway ..... 211/106.01
5,613,659 A * 3/1997 Hong ..... 248/205.5
6,381,890 B1 * 5/2002 Sjostedt ..... 40/637
6,564,981 B2 * 5/2003 Murphy ..... 224/277
7,520,080 B2 * 4/2009 Pitcher et al. ..... 40/658
7,555,858 B2 * 7/2009 Gerback et al. ..... 40/593
2002/0133992 A1 * 9/2002 Wu ..... 40/661.01
2004/0003526 A1 * 1/2004 Brooks et al. ..... 40/591
2004/0221498 A1 * 11/2004 Vico et al. ..... 40/593
2005/0016044 A1 * 1/2005 Kubicek et al. ..... 40/745
2007/0175076 A1 * 8/2007 Stanley ..... 40/593
2007/0289179 A1 * 12/2007 Mortensen ..... 40/514

* cited by examiner

*Primary Examiner* — Joanne Silbermann
*Assistant Examiner* — Kristina Junge
(74) *Attorney, Agent, or Firm* — Ted Masters

(57) ABSTRACT

A device for connecting a placard to the rearview mirror of a motor vehicle includes a hanger which connects to the stem of the rearview mirror. A placard holder has a first jaw and an opposite second jaw, the first and second jaws are shaped and dimension to removably receive the placard. The placard holder is removably connectable to the hanger. In embodiments of the invention, the placard holder is magnetically connected to the hanger, and the jaws of the placard holder are magnetically urged together to hold the placard.

7 Claims, 5 Drawing Sheets

Fig. 1
PRIOR ART
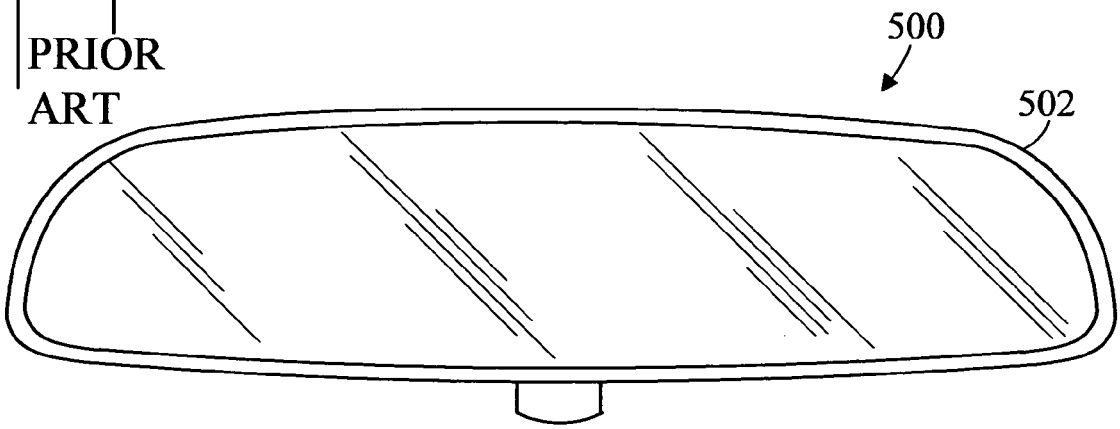
Fig. 2
PRIOR ART
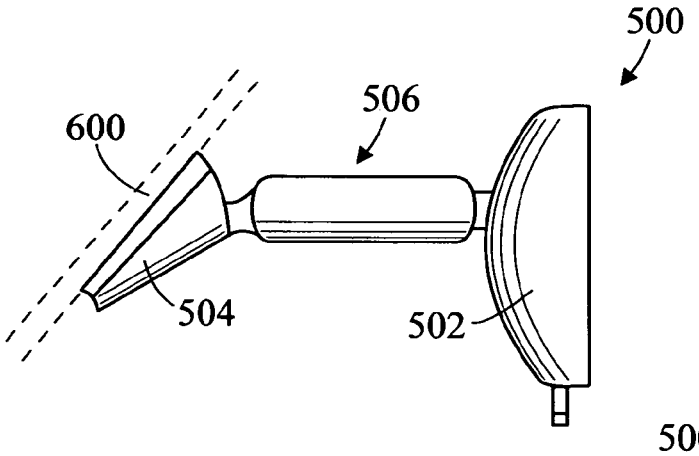
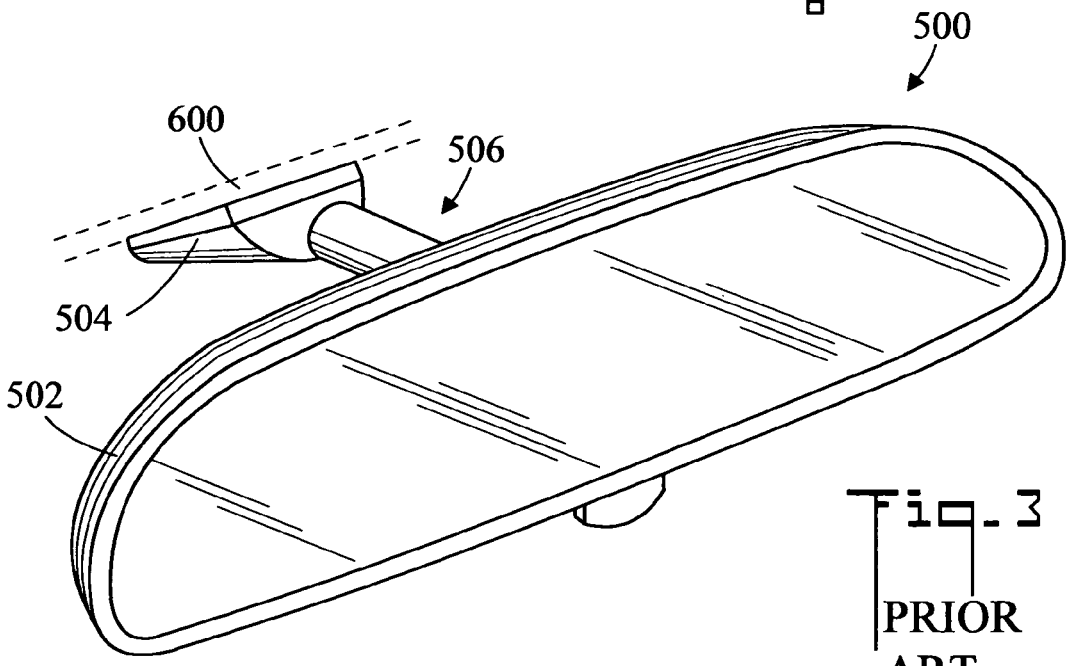
Fig. 3
PRIOR ART Fig. 7
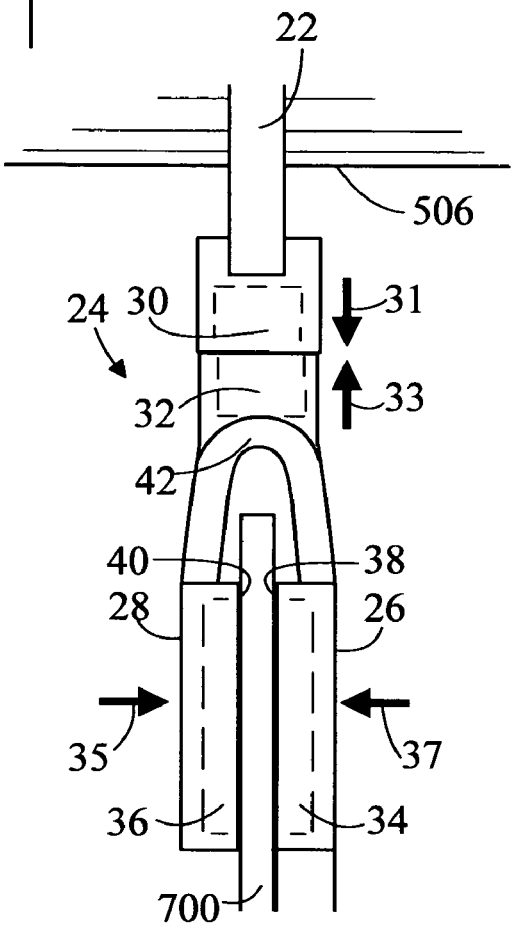
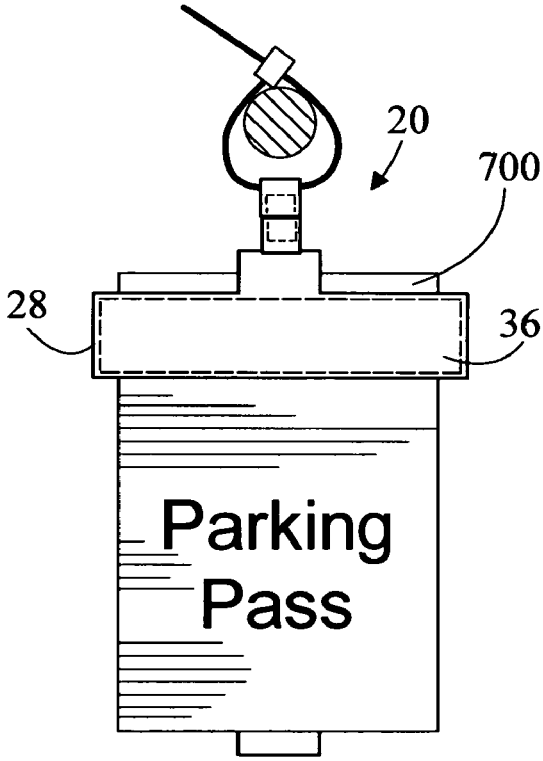
Fig. 8

Fig. 9
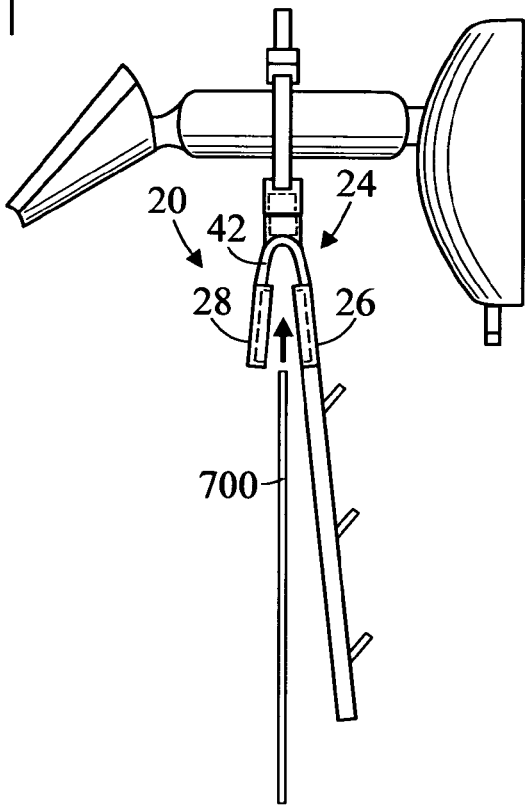
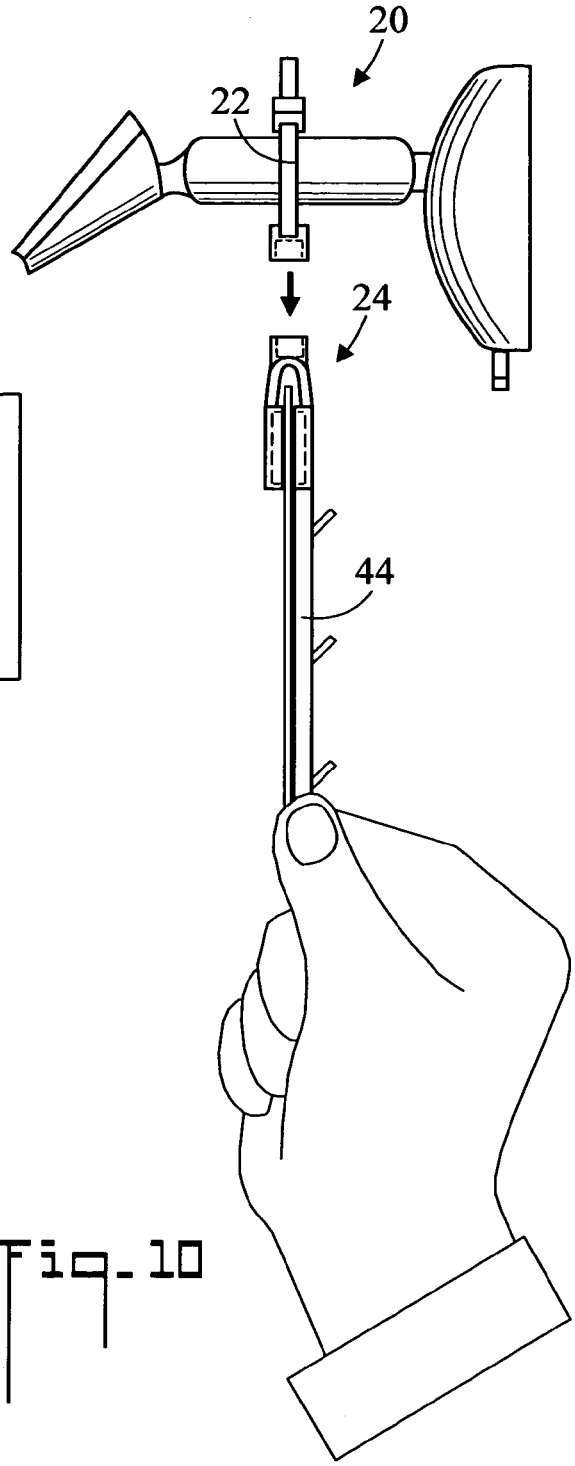
Fig. 10

DEVICE FOR CONNECTING A PLACARD TO THE REARVIEW MIRROR OF A MOTOR VEHICLE AND METHOD OF USE

CROSS REFERENCE TO RELATED APPLICATION

None

TECHNICAL FIELD

The present invention pertains generally to holders for displaying a placard or other printed substrate in the interior of a motor vehicle, and more particularly to a device which attaches to the rearview mirror so that the placard may be viewed from the outside of the vehicle.

BACKGROUND OF THE INVENTION

Vehicle passes must be displayed in motor vehicles when the motor vehicle enters or is parked in a restricted area. The vehicle pass oftentimes takes the form of a plastic placard which bears written authorization information. The placard must be displayed in a prominent location so that the operator of the restricted area can view the placard from outside the vehicle. The rearview mirror of the motor vehicle provides a convenient place to attach the placard. However, neither the placard nor the rearview mirror contain the structure to effect the attachment. Furthermore, in many instances the placards cannot be permanently mounted to the motor vehicle (e.g. to comply with visibility or other regulations), and between uses must be stored such as in the glove compartment of the motor vehicle.

BRIEF SUMMARY OF THE INVENTION

The present invention is directed to a device for connecting a placard to the rearview mirror of a motor vehicle. The device is conveniently and removably attachable to the stem of the rearview mirror, and is capable of holding placards and other such items of different dimensions and configurations. The device includes two elements: (1) a hanger connects to and encircles the stem of the rearview mirror, and (2) a placard holder has jaws which removably clamp and hold the placard. The placard holder is removably connectable to the hanger. Both the connection of the placard holder to the hanger, and the jaws of the placard employ magnetic elements.

In accordance with a preferred embodiment of the invention, a device for connecting a placard to a rearview mirror includes a hanger which connects to the stem of the rearview mirror. A placard holder has a first jaw and an opposite second jaw, the first and second jaws are shaped and dimension to removably receive the placard. The placard holder is removably connectable to the hanger.

In accordance with an aspect of the invention, the placard holder is magnetically connectable to the hanger.

In accordance with another aspect of the invention, a first magnetic member is disposed on the hanger. The placard holder has a top portion, and a second magnetic member is disposed on the top portion of the placard holder, wherein the first and second magnetic members cooperate to effect the magnetic connection of the placard holder to the hanger.

In accordance with another aspect of the invention, the first magnetic member is slidably connected to the hanger.

In accordance with another aspect of the invention, the hanger includes a tie wrap which surrounds the stem of the rearview mirror.

In accordance with another aspect of the invention, the first jaw includes a first magnetic member, and the second jaw includes a second magnetic member, so that the first and second jaws are magnetically urged together to hold the placard therebetween.

In accordance with another aspect of the invention, the first jaw has a first surface and the second jaw has a second surface. A friction enhancing material is disposed upon the first and second surfaces.

In accordance with another aspect of the invention, the placard holder includes a handle which downwardly projects from the first jaw. The handle includes a plurality of vertically spaced apart article-receiving stations.

In accordance with another aspect of the invention, each article-receiving station includes an upwardly projecting peg.

Other aspects of the present invention will become apparent from the following detailed description, taken in conjunction with the accompanying drawings, which illustrate, by way of example, the principles of the invention.

BRIEF DESCRIPTION OF THE DRAWINGS

FIG. 1 is a front elevation view of a prior art rearview mirror of a motor vehicle;

FIG. 2 is a side elevation view of the rearview mirror;

FIG. 3 is a perspective view of the rearview mirror;

FIG. 7 is an enlarged view of area 7 of FIG. 4;

FIG. 8 is a rear elevation view of the device;

FIG. 9 is a side elevation view of the device showing a placard being inserted therein;

FIG. 10 is a side elevation view of a placard holder being removed from a hanger; and, FIG. 11 is a front elevation view of an article attached to the device.

DETAILED DESCRIPTION OF THE INVENTION

Figure 4:
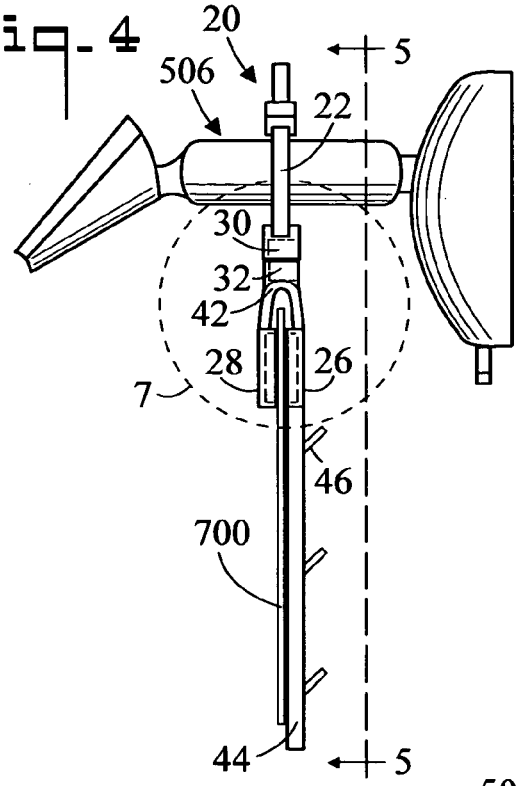
FIG. 4 is a side elevation view of a device for connecting a placard to the rearview mirror of a motor vehicle in accordance with the present invention.

Referring initially to FIGS. 1-3, there are illustrated front elevation, side elevation, and perspective views respectively of a prior art rearview mirror of a motor vehicle, generally designated as 500. Rearview mirror 500 is located inside the cabin of the motor vehicle and includes a mirror housing 502, a mirror mount 504 for connecting the rearview mirror 500 to the windshield 600 of the motor vehicle, and a generally horizontal stem 506 which is disposed between mirror housing 502 and mirror mount 504.

Figure 5:
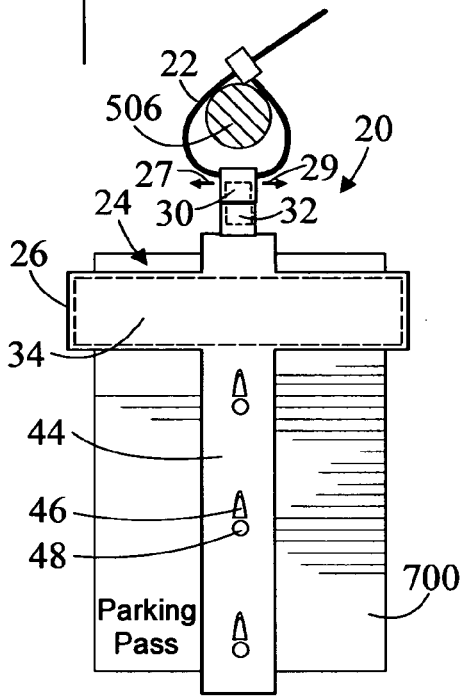
FIG. 5 is a front elevation view of the device along the line 5-5 of FIG. 4.
Figure 6:
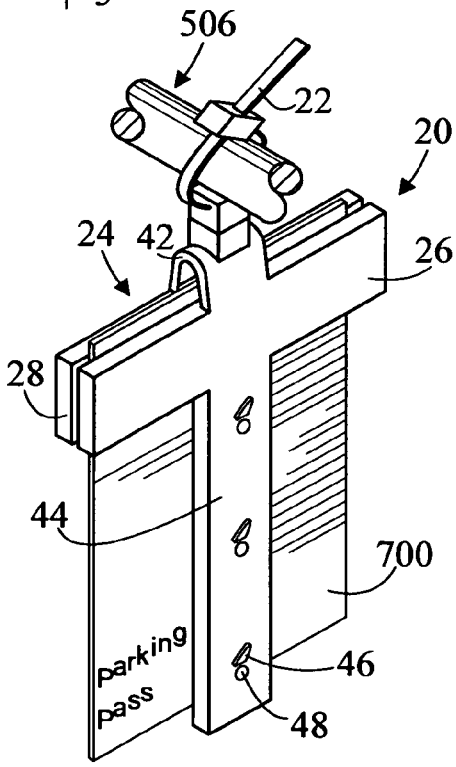
FIG. 6 is a perspective view of the device.

Now referring to FIGS. 4-6, there are illustrated side elevation, front elevation, and perspective views respectively of a device for connecting a placard 700 to the stem 506 of rearview mirror 500 (refer to FIGS. 1-3) of a motor vehicle in accordance with the present invention, the device generally designated as 20. FIG. 7 is an enlarged view of area 7 of FIG. 4. In the shown embodiment, placard 700 comprises a parking pass which is made from a sheet of plastic. However, it may be appreciated that placard 700 could take other forms such as a sheet of paper, a task list, an advertisement, a map, or any other generally flat object which is to be temporarily displayed.

Device 20 includes a hanger 22 which connects to stem 506 of rearview mirror 500. Hanger 22 provides the connective structure between stem 506 and the other elements of the present invention. In the shown embodiment, hanger 22 includes a conventional ratcheting action tie wrap which surrounds stem 506, and which may be permanently left in place.

Device 20 further includes a placard holder 24 which has a first jaw 26 and an opposite second jaw 28. First 26 and second 28 jaws are shaped and dimension to removably receive placard 700. Placard holder 24 is removably connectable to hanger 22. In the shown embodiment, placard holder 24 is magnetically connectable to hanger 22. A first magnetic member 30 is disposed on hanger 22. In the shown embodiment, first magnetic member 30 is slidably connected to hanger 22, so that it is slidably movable in the directions of arrows 27 and 29 in FIG. 5. Placard holder 24 has a top portion, and a second magnetic member 32 is disposed on the top portion of placard holder 24. First 30 and second 32 magnetic members cooperate to effect the magnetic connection of placard holder 24 to hanger 22 (as shown by arrows 31 and 33 on FIG. 7). As defined herein the term "magnetic member" means a member which is either a magnet or made from a material which is attracted by a magnet (such as iron). In the present invention a magnetic attraction exists between the first 30 and second 32 magnetic members. That is, at least one of first magnetic member 30 and second magnetic member 32 is a magnet. To that end, three configurations are possible: (1) first magnetic member 30 is a magnet, and second magnetic member 32 is made a material such as iron which is attracted by first magnetic member 30, (2) second magnetic member 32 is a magnet, and first magnetic member 30 is made a material such as iron which is attracted by second magnetic member 32, and (3) first magnetic member 30 is a magnet and second magnetic member 32 is a magnet of the opposite polarity. In an embodiment of the invention, a neodymium iron boride magnet is utilized. Also in an embodiment of the invention, first 30 and second 32 magnetic members are embedded in polymer housings.

First jaw 26 includes a first magnetic member 34, and second jaw 28 includes a second magnetic member 36, so that first 26 and second jaws 28 are magnetically urged together (as shown by arrows 35 and 37 in FIG. 7) to hold placard 700. It may be appreciated that first magnetic member 34 and second magnetic member 36 of jaws 26 and 28 respectively can have the same magnetic relationship as described above for first magnetic member 30 and second magnetic member 32. In another embodiment of the invention, first jaw 26 has a first surface 38 and second jaw 28 has a second surface 40. Friction enhancing material is disposed upon first 38 and second 40 surfaces, to enhance the grip of jaws 26 and 28 upon placard 700.

First jaw 26 and second jaw 28 are connected by a resilient hinge 42 which allow jaws to close (FIGS. 4-7) or open (FIG. 9). In the shown embodiment of the invention hinge 42 is integral with jaws 26 and 28.

Placard holder 24 also includes a handle 44 which downwardly projects from first jaw 26 to form a general T shape. Handle 44 provides weight which assures that placard holder 24 always assumes a downward hanging orientation. The slidable connection of first magnetic member of hanger 22 facilitates the downward orientation of placard holder 24. Handle 44 includes a plurality of vertically spaced apart article-receiving stations for receiving various articles (refer also to FIG. 11 and the associated discussion). In the shown embodiment each article-receiving station includes an upwardly projecting peg 46 to which the article can be connected. Each article-receiving station can also include a through hole 48.

FIG. 8 is a rear elevation view of device 20 showing second jaw 28 and second magnetic member 36. This view is the one presented to a person viewing placard 700 through the windshield of the motor vehicle.

FIG. 9 is a side elevation view of device 20 showing placard 700 being inserted therein. Jaws 26 and 28 are spread apart and placard 700 is inserted between them.

FIG. 10 is a side elevation view of placard holder 24 being removed from hanger 22. One hand is used to grasp handle 44 and pull down on placard holder 24, thereby separating placard holder 24 from hanger 22.

Figure 11:
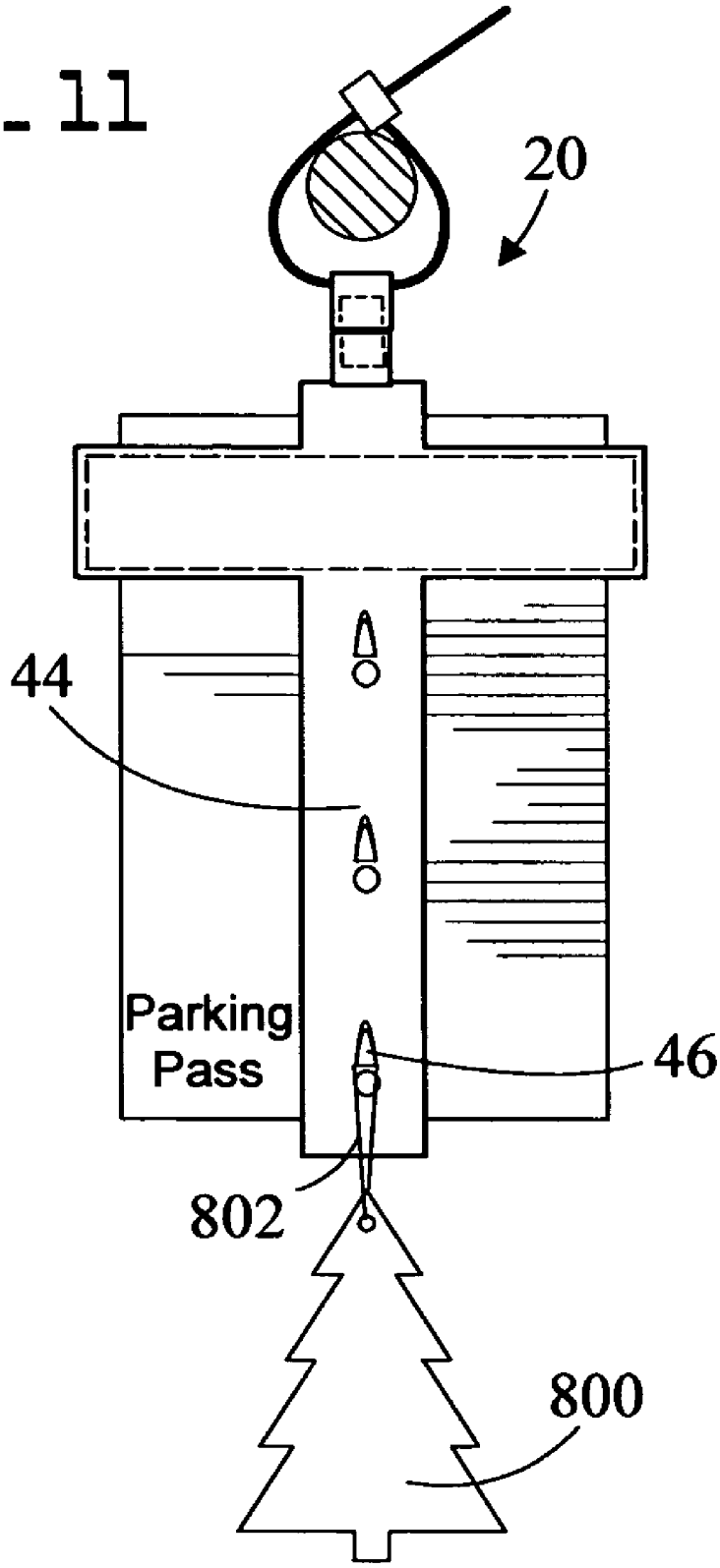

FIG. 11 is a front elevation view of an article 800 (such as an air freshener) attached to device 20. Article 800 includes a support sting 802 which hangs over upwardly projecting peg 46.

In terms of use, a method for displaying a placard on a motor vehicle, including: (refer to FIGS. 1-11)

(a) providing a motor vehicle, the motor vehicle having a rearview mirror 500 which includes a stem 506;

(b) providing a placard 700;

(c) providing a device 20 for connecting placard 700 to stem 506 of rearview mirror 506 of the motor vehicle, device 20 including:

a hanger 22 which connects to stem 506 of rearview mirror 500;

a placard holder 24 having a first jaw 26 and an opposite second jaw 28, first 26 and second 28 jaws shaped and dimension to removably receive placard 700; and, placard holder 24 removably connectable to hanger 22;

(d) connecting hanger 22 to stem 506 of rearview mirror 500;

(f) causing first 26 and second 28 jaws to receive placard 700; and, (g) connecting placard holder 700 to hanger 22. It may be appreciated that steps (f) and (g) could be reversed wherein placard holder 24 is first connected to hanger 22 and then placard 700 is inserted between jaws 26 and 28.

The method further including:

in step (c), placard holder 24 magnetically connectable to hanger 22; and, in step (g), causing placard holder 24 to be magnetically connected to hanger 22.

The method further including:

in step (c), a first magnetic member 30 disposed on hanger 22;

in step (c), placard holder 24 having a top portion; and, in step (c), a second magnetic member 32 disposed on the top portion of placard holder 24, wherein first 30 and second 32 magnetic members cooperate to effect the magnetic connection of placard holder 24 to hanger 22.

The method further including:

in step (c), placard holder 24 including a handle 44 which downwardly projects from first jaw 26; and, after step (g), using one hand to grasp handle 44 and pull down on placard holder 24, thereby separating placard holder 24 from hanger 22.

The method further including:

in step (c), hanger 22 including a tie wrap which surrounds stem 506 of rearview mirror 500; and, in step (d), causing the tie wrap to surround stem 506 of rearview mirror 500.

The method further including:

in step (c), first jaw 26 including a first magnetic member 30;

in step (c), second jaw 28 including a second magnetic member 32; and, in step (f), first 26 and second 28 jaws being magnetically urged together to hold placard 700 therebetween.

The method further including:

in step (c), placard holder 24 including a handle 44 which downwardly projects from first jaw 26;

in step (c), handle 44 including a plurality of spaced apart article-receiving stations.

providing an article 800; and, connecting article 800 to one of the plurality of article-receiving stations;

The method further including:

in step (c), each article-receiving station including an upwardly projecting peg 46;

article 800 including a support string 802; and, hanging support string 802 over upwardly projecting peg 46.

The preferred embodiments of the invention described herein are exemplary and numerous modifications, variations, and rearrangements can be readily envisioned to achieve an equivalent result, all of which are intended to be embraced within the scope of the appended claims.

I claim:

1. A device for connecting a placard to the rearview mirror of a motor vehicle, the rearview mirror having a stem, the device comprising:

a hanger which connects to the stem of the rearview mirror;

a placard holder having a first jaw and an opposite second jaw connected to said first jaw by a hinge, said first and second jaws shaped and dimension to removably receive the placard;

said placard holder removably and magnetically connectable to said hanger;

a first magnetic member disposed on said hanger;

said placard holder having a top portion;

a second magnetic member disposed on said top portion of said placard holder, wherein said first and second magnetic members cooperate to effect a vertical magnetic connection of said placard holder to said hanger with said first magnetic member disposed above said second magnetic member;

said hanger including a tie wrap which surrounds the stem of the rearview mirror, and, said first magnetic member slidably connected to said tie wrap.

2. A device for connecting a placard to the rearview mirror of a motor vehicle, the rearview mirror having a stem, the device comprising:

a hanger which connects to the stem of the rearview mirror;

a placard holder having a first jaw and an opposite second jaw connected to said first jaw by a hinge, said first and second jaws shaped and dimension to removably receive the placard;

said placard holder removably and magnetically connectable to said hanger;

said placard holder including a handle which downwardly projects from said first jaw;

said handle and said first jaw forming a T shape; and, said handle including a plurality of vertically spaced apart article-receiving stations.

3. The device according to claim 2, further including:

each said article-receiving station including an upwardly projecting peg, said upwardly projecting peg projecting toward said first jaw.

4. A device for connecting a placard to the rearview mirror of a motor vehicle, the rearview mirror having a stem, the device comprising:

a hanger which connects to the stem of the rearview mirror;

a placard holder having a first jaw and an opposite second jaw connected to said first jaw by a hinge, said first and second jaws shaped and dimension to removably receive the placard;

said placard holder removably and magnetically connectable to said hanger;

a first magnetic member disposed on said hanger;

said placard holder having a top portion;

a second magnetic member disposed on said top portion of said placard holder, wherein said first and second magnetic members cooperate to effect a vertical magnetic connection of said placard holder to said hanger with said first magnetic member disposed above said second magnetic member;

said hanger including a tie wrap which surrounds the stem of the rearview mirror;

said first magnetic member slidably connected to said tie wrap;

said first jaw including a first jaw magnetic member;

said second jaw including a second jaw magnetic member;

so that said first and second jaws are magnetically urged together to hold the placard therebetween;

said placard holder including a handle which downwardly projects from said first jaw;

said handle and said first jaw forming a T shape;

said handle including a plurality of vertically spaced apart article-receiving stations; and, each said article-receiving station including an upwardly projecting peg, said upwardly projecting peg projecting toward said first jaw.

5. A method for displaying a placard on a motor vehicle, comprising:

(a) providing a motor vehicle, said motor vehicle having a rearview mirror which includes a stem;

(b) providing a placard;

(c) providing a device for connecting said placard to said stem of said rearview mirror of said motor vehicle, said device including:

a hanger which connects to said stem of said rearview mirror;

a placard holder having a first jaw and an opposite second jaw connected to said first jaw by a hinge, said first and second jaws shaped and dimension to removably receive said placard;

said placard holder removably and magnetically connectable to said hanger;

(d) connecting said hanger to said stem of said rearview mirror;

(f) spreading said first and second jaws apart and inserting said placard therebetween;

(g) connecting said placard holder to said hanger;

in (c), a first magnetic member disposed on said hanger;

in (c), said placard holder having a top portion;

in (c), a second magnetic member disposed on said top portion of said placard holder, wherein in (g) said first and second magnetic members cooperate to effect a magnetic connection of said placard holder to said hanger with said first magnetic member disposed above said second magnetic member;

in (c), said hanger including a tie wrap which can surround said stem of said rearview mirror, said first magnetic member slidably connected to said tie wrap; and, in (d), causing said tie wrap to surround said stem of said rearview mirror.

6. A method for displaying a placard on a motor vehicle, comprising:

(a) providing a motor vehicle, said motor vehicle having a rearview mirror which includes a stem;

(b) providing a placard;

(c) providing a device for connecting said placard to said stem of said rearview mirror of said motor vehicle, said device including:

a hanger which connects to said stem of said rearview mirror;

a placard holder having a first jaw and an opposite second jaw connected to said first jaw by a hinge, said first and second jaws shaped and dimension to removably receive said placard;

said placard holder removably and magnetically connectable to said hanger;

(d) connecting said hanger to said stem of said rearview mirror;

(f) spreading said first and second jaws apart and inserting said placard therebetween;

(g) connecting said placard holder to said hanger;

in (c), said placard holder including a handle which downwardly projects from said first jaw, said handle and said first jaw forming a T shape;

in (c), said handle including a plurality of spaced apart article-receiving stations, providing an article; and, connecting said article to one of said plurality of article-receiving stations.

7. The method of claim 6, further including:

in (c), each said article-receiving station including an upwardly projecting peg, said upwardly projecting peg projecting toward said first jaw;

said article including a support string; and, hanging said support string over said upwardly projecting peg.

* * * * *